United States Patent [19]

Shuff

[11] 4,109,325

[45] Aug. 29, 1978

[54] INFLATABLE SWIMMING POOL COVER SYSTEM

[76] Inventor: Gregory Douglas Shuff, 311 Avenida Cerritos, Newport Beach, Calif. 92660

[21] Appl. No.: 744,407

[22] Filed: Dec. 30, 1976

Related U.S. Application Data

[63] Continuation-in-part of Ser. No. 612,846, Sep. 12, 1975, abandoned.

[51] Int. Cl.[2] ..... E04H 3/19

[52] U.S. Cl. ..... 4/172.12

[58] Field of Search ..... 4/172.12, 172.13, 172.14; 135/1 R; 52/2

[56] References Cited

U.S. PATENT DOCUMENTS

| | | | |
|---|---|---|---|
| 3,072,920 | 1/1963 | Yellott | 4/172 |
| 3,277,498 | 10/1966 | Kleinbard | 4/172.14 |
| 3,676,880 | 7/1972 | Kwake | 4/172.12 |
| 3,747,131 | 7/1973 | Koliomichalis | 4/172.12 |
| 3,810,262 | 5/1974 | Strand | 4/172.12 |
| 3,877,084 | 4/1975 | Johnson et al. | 4/160 |
| 3,927,427 | 12/1975 | Aine | 4/172.14 |

*Primary Examiner*—Charles E. Phillips

*Attorney, Agent, or Firm*—Fulwider, Patton, Rieber, Lee & Utecht

[57] ABSTRACT

An air supportable structure for a swimming pool, including a buoyant cover having a floating position in which it lies flat on the pool surface, and a raised position in which it is inflated and raised above the pool. The cover includes a skirt which is submerged in the floating position of the cover by a ballast tube. The skirt is visible only on inflation of the cover, at which time the skirt is substantially completely out of the water.

3 Claims, 4 Drawing Figures

INFLATABLE SWIMMING POOL COVER SYSTEM

CROSS-REFERENCE TO RELATED APPLICATION

This is a continuation-in-part of my application Ser. No. 612,846, filed Sept. 12, 1975 now abandoned.

BACKGROUND OF THE INVENTION

Recent energy shortages throughout the world are placing a greater emphasis on developing new techniques to replace or assist conventional means in providing energy. One such area is the controversial issue over the use of natural gas fired swimming pool heaters. An acceptable alternate approach to this problem is the utilization of solar energy. This approach is effective; however, to heat a pool in cold regions or winter months, it is imperative to cover a pool to reduce heat losses from the surface. In fact, in many regions it is possible to heat the pool, during summer months, to desired temperature with the cover alone, and no additional sources of heat input. In addition, a cover will greatly reduce the amount of natural gas needed to heat pools with present day conventional pool heaters.

To my knowledge, no inflatable swimming pool cover system has been developed to: (a) provide solar heat input, (b) custom fit to the pool, (c) attractive, (d) easy to use and operate. It is an object of this invention to provide such a system.

SUMMARY OF THE INVENTION

An air supportable structure for a swimming pool, the structure including a central cover having a floating position and a raised position. The cover is buoyant and lies flat upon the water in its floating position. A skirt is attached to the cover margins and is submerged by a ballast system when the cover is in its floating position. Upon inflation of the cover to its raised position the skirt rises above the water surface.

In one embodiment the air supportable structure comprises an air mattress custom fit to the contours of the pool, sidewalls, water tubes, air ducts, and air blowers.

The air mattress is fabricated from flexible plastic material, producing an air mattress 2 to 4 inches in thickness when inflated with air. The plastic material is made of blue tint, transparent material to match the color of a swimming pool. The air mattress is inflated by means of a low pressure air blower and air manifold arrangement to transport the air from the blower to the air mattress. The air mattress is intended to float on the surface in normal operation, while not extending over pool edges, giving a very pleasing appearance.

Sidewalls are attached to the periphery of the top portion and a sleeve-water tube arrangement is attached at the opposite edge of the sidewall. Sidewall, sleeve, and water tubes are fabricated from a flexible plastic material having a specific weight and density greater than water. The sidewall is normally constructed from a clear, transparent material. This construction will allow the sidewalls, sleeve, and water tubes to submerge under the surface, thus storing these portions of the air structure and hiding them from view by observers.

A second air blower is employed along with an air duct to transport air under the air mattress and within the air structure so as to inflate the air structure lifting the air mattress and sidewalls off the water, while the water tube provides an air seal around the bottom edge. Inflation normally takes five minutes and raises the structure 5 to 7 feet in height.

A zipper entrance is provided for easy access in and out of pool. An air circulation port is provided to insure a continual air circulation within the air structure when inflated. In addition, air deflation ports will add to the circulation but their prime purpose is to insure timely deflation of the air structure.

The system is easy to use and operate. In its normal position the air mattress is floating on the surface, does not extend over the pool edges, and the sidewalls and water tubes are submerged, hidden from view. When an individual would like to use his pool, he simply turns on a switch operating the air blower, waits 5 minutes and the system is inflated to provide ample swimming and recreational space underneath. When he is finished using the pool he simply turns the blower off, and the system will settle back down to its deflated state, in a timely fashion.

OBJECTS AND ADVANTAGES OF THE INVENTION

There are several objects of this invention. First, the inflatable swimming pool cover system will increase water temperature by converting solar energy or the sun's rays into heat. It will do this as a result of the "green house" heating effect which will occur in the entrapped air within the mattress, and transferring part of this heat to the water below.

Second, the system will reduce heat losses due to (a) evaporation, (b) conduction, and (c) reradiation. By entrapping a layer of air in the mattress, the surface of the water is actually insulated from the outside colder air and breezes. The top plastic sheet reduces reradiation heat losses to a clear night sky.

Third, this system will reduce or eliminate the need for natural gas swimming pool heaters. Heat can be converted from sunlight in those geographical areas permitting, to allow comfortable swimming temperatures during summer months.

Fourth, the system will work in conjunction with other solar heating systems to provide year round solar pool heating.

Fifth, the system is a passive solar heating system and requires no waterflow through the system for operation. This means no plumbing, no pumps, no hookups and no costly installation expenses normally associated with these types of systems.

Sixth, the system is a low cost approach to solar pool heating.

Seventh, the system does not distract from the pool appearance or landscaping. The color of the mattresses matches that of the blueish color of the pool water.

Eighth, the system is easy to use and operate. An air blower is switched on and the air structure is inflated to provide ample swimming room and recreational space underneath.

Ninth, the system will keep dirt, dust, leaves and other debris out of the swimming pool.

Tenth, the system will provide an indoor climate for protection from outside wind, rain, and cold.

Eleventh, the system will provide privacy.

Twelfth, the system will reduce pool operating costs.

Thirteenth, the system may aid in preventing deaths by drowning.

DETAILED DESCRIPTION OF THE PREFERRED EMBODIMENTS

Figure 1:
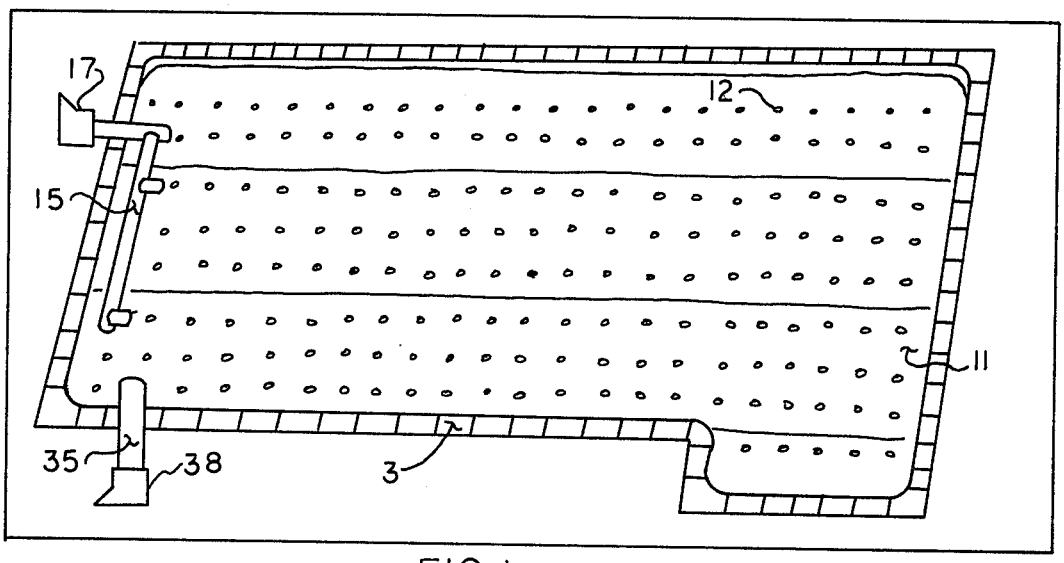
FIG. 1 is a perspective view of a swimming pool with the air structure system of this invention positioned thereon.

The inflatable swimming pool cover system of this invention as shown in the embodiment of FIGS. 1–4, depicts an air supportable structure 21, having a cover or top portion 11, a skirt or sidewalls 22, tubular sleeve 24, ballast or water tubes 25, two air blower mechanisms 17 and 38, an air manifold arrangement 15, an air duct 35, air circulation ports 32, air deflation ports 33, and a zipper entrance 31.

The top portion 11 is comprised of two sheets of flexible plastic film, preferably made of polyvinyl chloride of between 8 to 20 mils in thickness. Both sheets have transparent properties, although one sheet may be black or opaque. The sheets are 4 feet in width and the length of the described swimming pool 1 to be covered. The sheets are heat welded by conventional ultra high frequency welding techniques.

Circular heat welds 12 are evenly spaced over the entire surface of the air mattress so as to give the inflated air mattress a thickness of 2 to 4 inches, one 4-ft. section is heat welded to other 4-ft. sections until the desired width is achieved. Then the combined sections are cut a small percentage (8%) oversize of the exact portion of the swimming pool 1 to be covered. This will comprise the top portion 11. An air manifold 15 consisting of flexible plastic film heat welded to form a tube 3 inches in diameter, is heat welded through the top sheet of each section of the top portion 11. The opposite end of the air manifold is firmly attached to an air blower 17.

A low volume/low pressure air blower 17 is utilized to inflate and the air space between the two sheets of the top portion 11. Static cutoff pressures will be attained and should there be an air leak in the top portion 11, the air blower 17 will replace the escaped air.

Figures 2, 3:
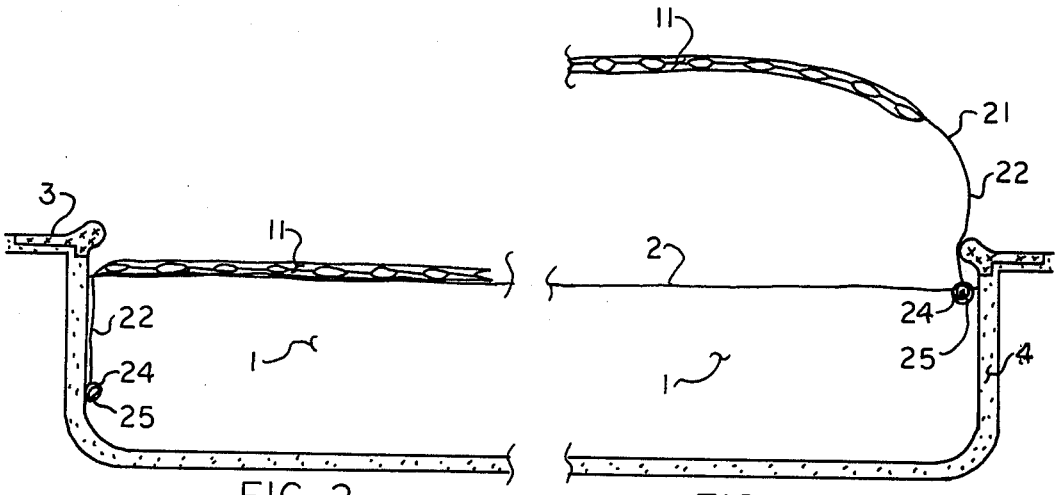
FIG. 2 is a cross-sectional view of the system in the deflated position.
FIG. 3 is a cross-sectional view of the system in the inflated position.

Heat welded to the edge margins of periphery of the top portion 11, as seen in FIG. 2, are the upper edge margins of the sidewall 22 which is composed of a clear flexible plastic film of greater specific weight and density than water. The sidewall 22 is preferably 3 feet in widthand 20 mils in thickness. As illustrated, the sidewall 22 is free of attachment to the structure of the swimming pool.

Heat welded to the lower edge margins of the periphery of the sidewall 22 is a sleeve 24 as depicted in FIGS. 1–4, composed of a flexible plastic film of greater specific weight and density than water. The sleeve 24 has cutouts for water tube 25 insertion, and is preferably 8 inches in diameter and 20 mils in thickness.

Placed within the dimensions and periphery of the sleeve 24 are water tubes 25. These water tubes are made in varying lengths up to 10 feet, and composed of flexible plastic film of greater specific weight and density than water, that is, of negative buoyancy. The edges are heat welded to form a tube preferably 6 inches in diameter. A water filling valve 26 is heat welded in the water tube 25, and the tube is filled with water to 80% capacity in normal use. It must be noted that the tube could be filled so that no air remains in the tube. Short water tubes 25 are used in curves and corners as a straight line approximation. The tube 25 and sleeve 24 are freely movable upwardly and downwardly, as illustrated, being unattached to the swimming pool sidewalls.

FIG. 2 depicts a cross-section view of the air structure 21 in floating position or deflated state over the swimming pool 1. As shown, the top portion 11 floats substantially flat upon the surface 2. The sidewall 22, sleeve 24, and water tube 25 are all submerged underneath the surface 2 as a result of the specific weight of the material used. Also shown in FIG. 2 are other portions of the swimming pool 1, such as the coping 3 and pool peripheral sidewalls 4.

FIG. 3 depicts a cross-section view of the air structure 21, in its raised position or inflated state over the pool 1. As shown, the top portion 11 is approximately 5′ – 7′ above the surface of the pool, the sidewall 22 is extended out of the water, the water tube 25 and sleeve 24 are adjacent the surface (2). Also depicted is a second low pressure air blower 38 used to provide air beneath the top portion 11 at a pressure sufficient to inflate said air structure 21 by switching it on. An air duct 35 transports the air from the blower 38 to within the air structure 21.

The air duct 35 is composed of flexible plastic film, preferably 20 mills in thickness and 12 inches in diameter. One end is firmly fastened to the air blower 38, while the opposite end is heat welded through the top portion 11 of the air structure 21. It is important for the proper functioning of the air structure 21 that the air duct 35 be attached to the top portion 11 and no other part of the air structure 21. Otherwise, the air duct 35 would be submerged and the air blower 38 does not provide the high pressure required to lift the air duct 35 out of the water.

Figure 4:
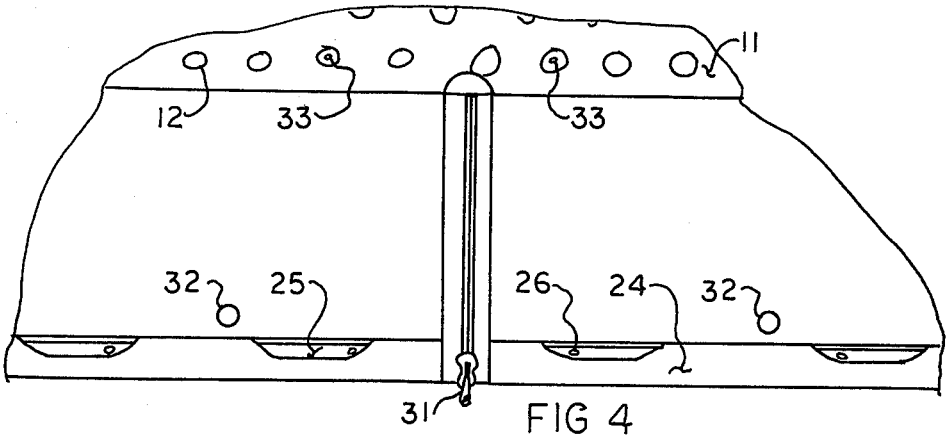
FIG. 4 is an expanded view of the entrance, air circulation and deflation ports.

FIG. 4 depicts the air structure 21 entrance 31, air circulation port 32, air deflation port 33, sleeve 24, and water tube 25.

The entrance 31 is composed of a flexible zipper, heat welded to the sidewall 22 so as to open from the bottom through the sleeve 25 extending upward through the sidewall 22 and stopping just before the top portion 11.

Air circulation ports 32 are provided in the sidewall in close proximity to the sleeve 24 so as to relieve pressures and to provide a continual air circulation within the air structure 21. These ports 32 are preferably 2 inches in diameter.

Air deflation ports 33 are provided in the heat welds 12 of the top portion 11 normally one-fourth inch in dimater and evenly spaced throughout the top portion 11. These ports 33 are required for the timely deflation of the air structure 21 once the air blower 38 is switched off. In addition, the ports 33 add to the air circulation within the structure.

While particular forms of the inflatable swimming pool cover system have been illustrated and described, various modifications can be made without departing from the spirit and scope of the invention.

I claim:

1. An air supportable structure for a swimming pool having peripheral side walls, said structure comprising:

a central cover having a floating position and a raised position and made of two sheets of plastic material bonded together to form an air space there between cover is itself buoyant, when inflated said material being configured and dimensioned to closely approximate the configuration and dimensions of the swimming pool and thereby substantially completely cover the swimming pool water surface and float substantially flat upon the said surface in said floating position of said cover;

a peripheral skirt made of sheet material of lesser buoyancy than said central cover and having upper edge margins attached to the edge margins of said cover, said skirt being free of attachment to the structure of said swimming pool whereby, in said floating position of said cover, said skirt extends downwardly in submerged relation below the swimming pool water surface;

ballast means attached to the lower edge margins of said skirt, said ballast means being freely movable upwardly and downwardly in the swimming pool water and of sufficient negative buoyancy to maintain said skirt below the swimming pool water surface in said floating position of said cover; and means for introducing air beneath said cover at a pressure sufficient to lift said cover to said raised position such that a space is provided between said cover and said water surface sufficient for swimming and recreation, said skirt being located generally above the swimming pool water surface in said raised position, with said ballast means located in the swimming pool water.

2. An air supportable structure according to claim 1, wherein said ballast means is generally coextensive with said skirt.

3. An air supportable structure according to claim 2 wherein said ballast means comprises tube means containing water.

* * * * *

UNITED STATES PATENT AND TRADEMARK OFFICE

CERTIFICATE OF CORRECTION

PATENT NO. : 4,109,325

DATED : August 29, 1978

INVENTOR(S) : GREGORY DOUGLAS SHUFF

It is certified that error appears in the above-identified patent and that said Letters Patent are hereby corrected as shown below:

Column 3, line 44, after "and" insert -- pressurize --.

Column 4, line 10, after "in" insert -- its --.

Column 5, line 1, before "cover" insert --whereby said--;

Column 5, line 1, delete the comma after "buoyant" and instead insert it after "inflated";

Signed and Sealed this

Third Day of July 1979

[SEAL]

*Attest:*

*Attesting Officer*

LUTRELLE F. PARKER

*Acting Commissioner of Patents and Trademarks*